US007226098B1

(12) United States Patent
Moreira

(10) Patent No.: US 7,226,098 B1
(45) Date of Patent: Jun. 5, 2007

(54) PET WASTE AND REFUSE COLLECTION SYSTEM AND METHOD

(76) Inventor: Joao Emilio Dias Moreira, 3661 44th Ave. South, Minneapolis, MN (US) 55406

( * ) Notice: Subject to any disclaimer, the term of this patent is extended or adjusted under 35 U.S.C. 154(b) by 0 days.

(21) Appl. No.: 11/419,194

(22) Filed: May 18, 2006

(51) Int. Cl.
*A01K 29/00* (2006.01)
*E01H 1/12* (2006.01)

(52) U.S. Cl. ..... 294/1.4; 294/64.1

(58) Field of Classification Search ..... 294/1.3, 294/1.4, 64.1; 119/161; 15/257.1, 257.3, 15/257.6

See application file for complete search history.

(56) References Cited

U.S. PATENT DOCUMENTS 4,078,838 A * 3/1978 Nadratowski ..... 294/1.4
4,185,355 A * 1/1980 Williams ..... 15/344
4,478,448 A * 10/1984 Albert ..... 294/1.4
6,880,873 B2 * 4/2005 Stoev ..... 294/1.4
7,003,846 B2 * 2/2006 Holtz ..... 15/344

* cited by examiner

*Primary Examiner*—Dean J. Kramer
(74) *Attorney, Agent, or Firm*—David A. Lingbeck

(57) ABSTRACT

System and method for vacuum actuated collection of pet waste and refuse. The system comprises a vacuum assembly operatively disposed in a vacuum chamber. The vacuum chamber is in operative fluid communication with a receiving chamber that receives and at least temporarily holds the vacuum lifted per waste and/or refuse. A handle assembly and actuator are operatively coupled to the vacuum assembly to control the generation of the vacuum. A collector may be disposed at least partially in the receiving chamber to permit easy disposal of the pet waste and refuse.

13 Claims, 11 Drawing Sheets

PET WASTE AND REFUSE COLLECTION SYSTEM AND METHOD

BACKGROUND OF THE INVENTION

1. Field of the Invention

The present invention relates to pet waste and refuse collection and more particularly pertains to a new vacuum actuated system and method for collecting pet waste collection and other refuse.

2. Description of the Prior Art

Pet owners have continuously been plagued by having to collect and dispose of their pet's waste. Conventional devices and methods of collecting pet waste and other refuse have included shovels, scoopers, and bags. All of these devices are difficult to use and/or require immediate cleaning.

Refuse collectors have traditional utilized an elongate handle having a nail or other sharpened device on its end. The nail is used to stab the refuse and transport it to a receptacle such as a bag. Although this device is adequate for its intended purpose it has a disadvantage of requiring the user to repeatedly stab the refuse to secure it to the handle. Only after it is secured to the handle can it be transported to the receptacle. The need to repeatedly stab the refuse expends time and energy of the user.

What is needed in the pet waste and refuse collection industries is a device that is easily and quickly used, and does not require cleaning immediately after being used.

SUMMARY OF THE INVENTION

A system and method for vacuum actuated collection of pet waste and/or refuse such as trash, garbage, and other discarded objects. The system comprises a vacuum assembly operatively disposed in a vacuum chamber. The vacuum chamber is in operative fluid communication with a receiving chamber that receives and at least temporarily holds the vacuum lifted pet waste and/or refuse. A handle assembly and actuator are operatively coupled to the vacuum assembly to control the generation of the vacuum. A collector may be disposed at least partially in the receiving chamber to permit easy disposal of the pet waste and/or refuse.

An advantage of the present invention is that it permits collection of pet waste and/or refuse without requiring a user to bend or kneel. Thereby, providing assistance to the elderly and disabled who may not be as mobile.

Another advantage of the present invention is that permits the collection of pet waste and/or refuse without direct contact by the user. This is particularly relevant when collecting pet waste or other potentially toxic waste.

Still yet another advantage of the present invention is that it is easy to use and inexpensive to purchase and operate.

Yet still another advantage of an example embodiment of the present invention is that it permits vacuuming of pet waste and/or refuse without the need of an electric motor. The absence of an electric motor and power supply greatly reduces the weight of the present invention making it more user friendly.

The above summary of the invention is not intended to describe each illustrated embodiment or every implementation of the invention. The figures in the detailed description that follow more particularly exemplify these embodiments.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Referring to FIGS. 1–11, a pet waste and refuse collection system is indicated by the number 100. In an example embodiment of the present invention, the system 100 includes a housing assembly 110 and a vacuum assembly 200 operatively disposed in the housing assembly 110 to generate a vacuum to lift or collect pet waste, refuse and other debris into a portion of the housing assembly 110 from a subjacent ground or floor surface.

Figure 1:
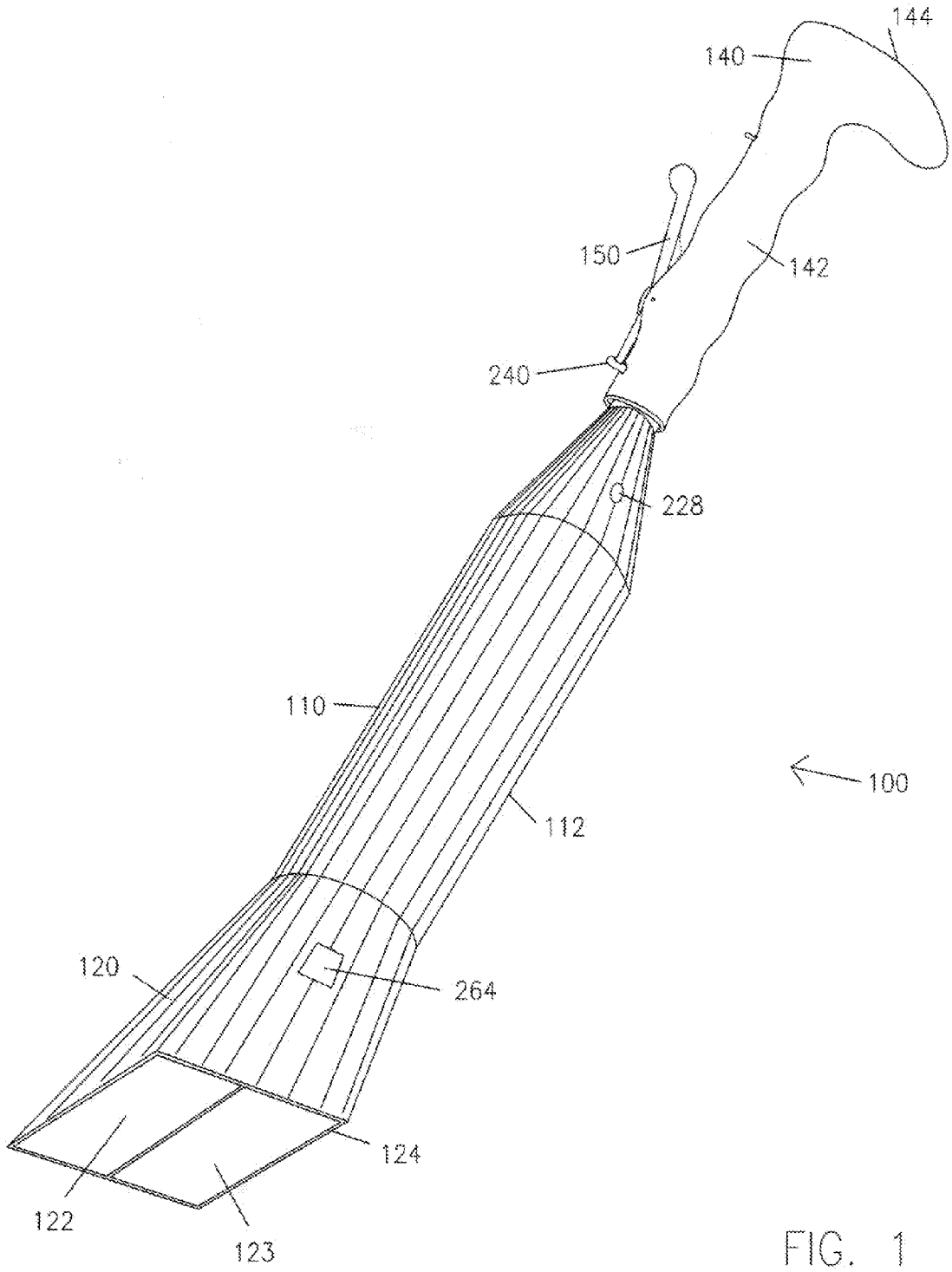
FIG. 1 is a perspective view of a pet waste collection system according to an example embodiment of the present invention.

Referring to FIG. 1, the housing assembly 110 includes a vacuum chamber 112 for holding vacuum assembly 200. A waste-receiving chamber 120 is operatively disposed on or formed in an end of the vacuum chamber 112. The waste-receiving chamber 120 is in fluid communication with the vacuum chamber 112 such that when the vacuum assembly 200 is activated it creates a vacuum or suction in the waste-receiving chamber 120. In one example embodiment, the vacuum chamber 112 has a generally circular cross section. However, it may have any geometric cross section such as oval, square, triangular, or any other similar geometric shape. The vacuum chamber 112 may also include outer pocket or storage compartments for storing per toys or tools depending upon the usage of the system 100.

Figure 3:
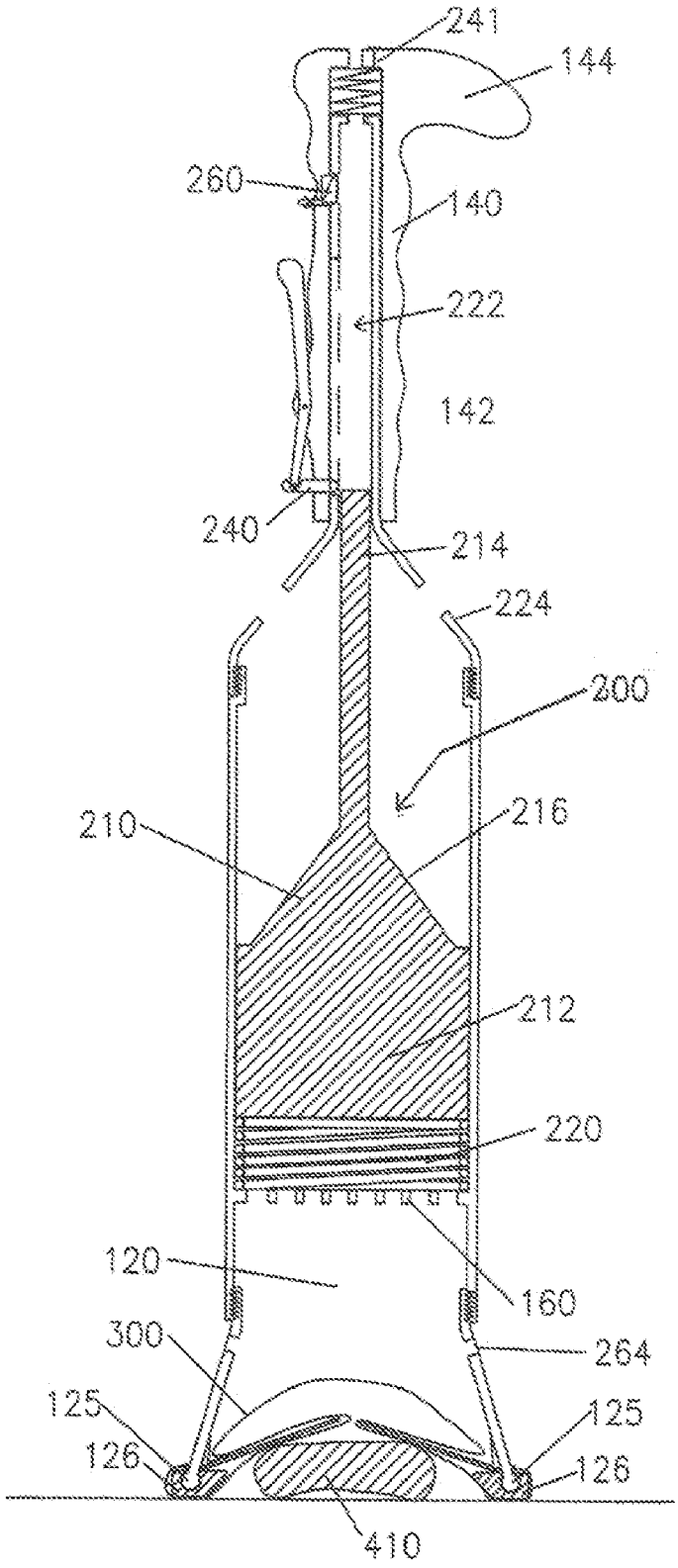
FIG. 3 is a cross section view of the system in a pet waste engagement position and a plunger in pre-vacuum position.
Figure 4:
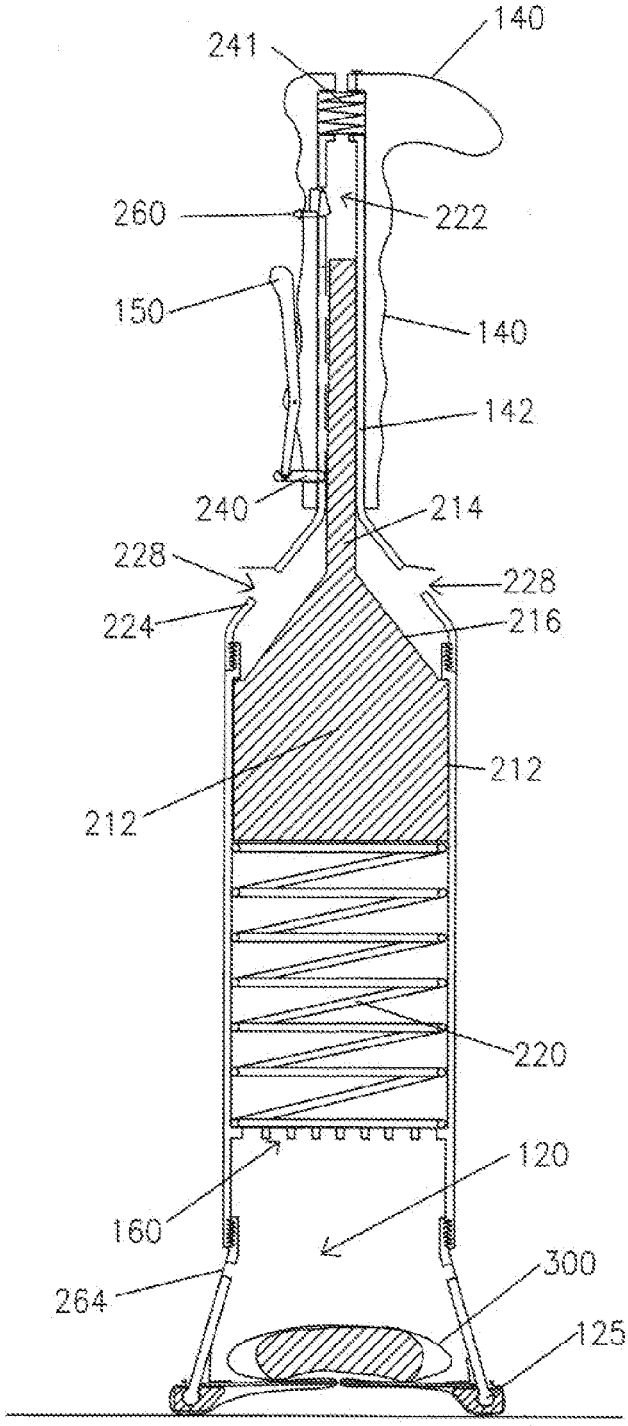
FIG. 4 is a cross section view of the system in a pet waste collection position and a plunger in a post-vacuum position.

The waste-receiving chamber 120 includes at least one flap valve 122 that is operatively coupled thereto for selectively blocking an access opening 124 thereof. In one embodiment, as particularly illustrated in FIG. 1, a pair of flap valves 122 and 123 are operatively coupled to the waste-receiving chamber 120. The flap valves 122 and 123 are pivotally positionable between a generally closed position, as illustrated in FIG. 1, and an open position. When the vacuum assembly 200 is actuated, the flap valves 122 and 123 are lifted from the closed position toward the open position as illustrated in FIG. 3. In the open position the flap valves 122 and 123 are disposed generally in the interior of the waste-receiving chamber 120. As illustrated in FIG. 4, when the suction generated by the vacuum assembly 200 is terminated, gravity preferably moves the flap valves 122 and 123 from the open position toward the closed position locking or preventing the escape of the pet waste or refuse.

Figure 2:
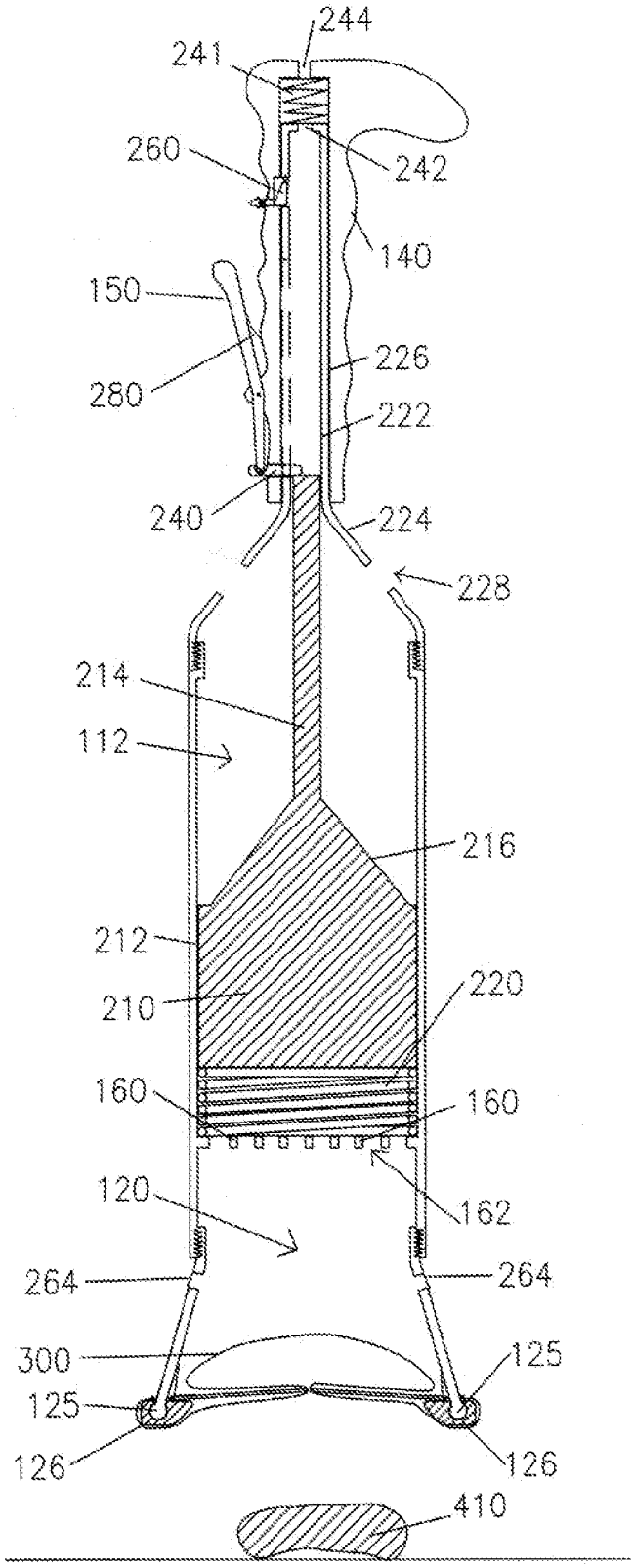
FIG. 2 is a cross section view of the system in a pre-collection position.

Referring to FIG. 2, the waste-receiving chamber 120 includes a peripheral lip 125 extending away from an end thereof for defining a pocket 400 along with the flap valves 122 & 123 for the pet waste and/or refuse before being vacuumed into the waste-receiving chamber 120. A gasket 126 may be removably and conventionally disposed on or attached to a free end of the peripheral lip 126 for creating a seal or at least a partial seal with the subjacent ground or floor surface.

Figure 11:
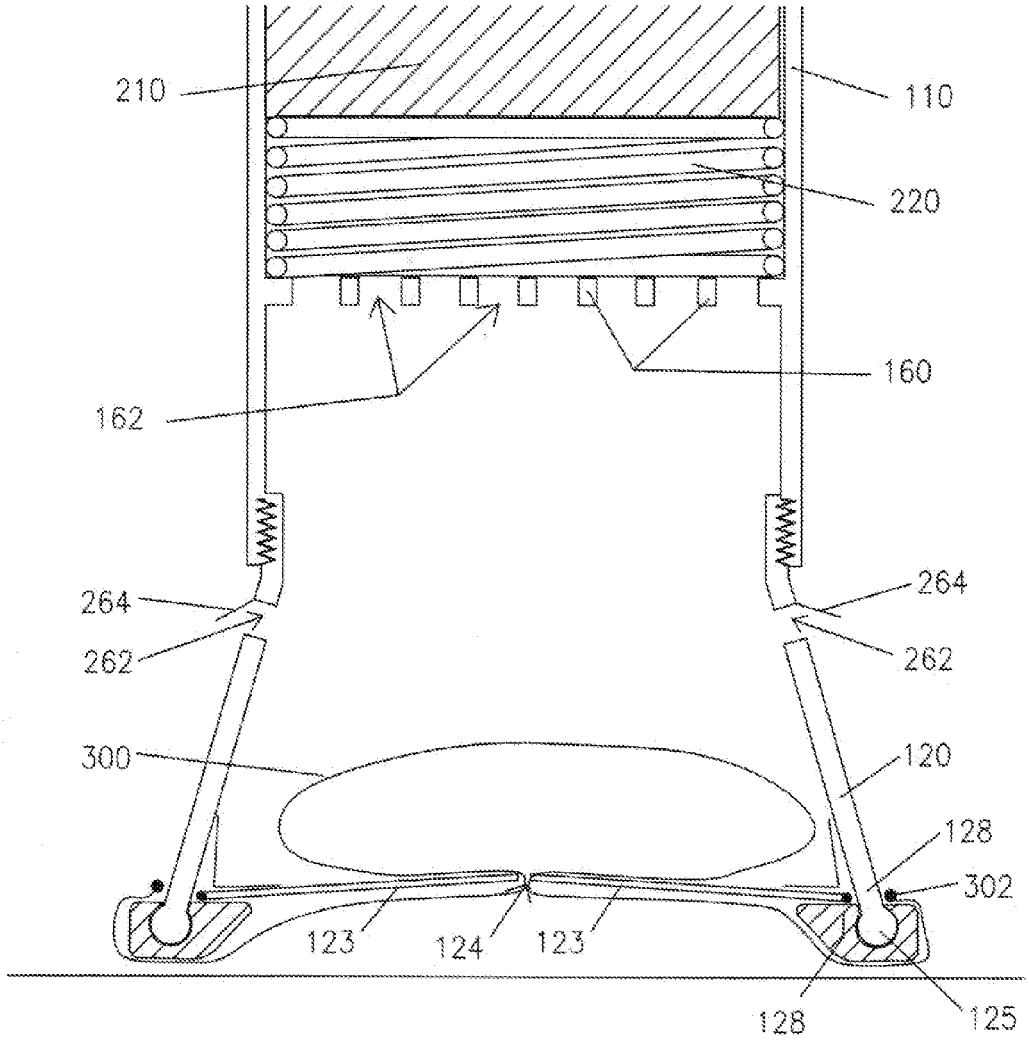
FIG. 11 is an enlarged view of a waste-receiving assembly of the system.

As particularly illustrated in FIG. 11, the gasket 126 includes a lip portion 128 extending away therefrom and into the pocket 400. The lip portion 128 acts as a support for the flap valves 122 and 123 when they are in the closed position. The gasket 126 may extend along a portion or an entire length of the peripheral lip 125. The peripheral lip 125 may include a bulbous end that is mateable with a like shaped channel formed in the gasket 126 to ensure sufficient coupling between the two. Other means of attachment may also be utilized.

Although not shown, an outer surface of the gasket 126 may have channels or grooves formed therein for controlling a direction of a flow of air into the pocket 400. The direction of the flow of air assists in moving the pet waste and/or refuse into the receiving chamber. In one example embodiment, the channels or grooves may be linear, complicated curves that permit a vortex flow of air, or any combination of the two. The patterning of the channels or grooves may be varied. The gasket 126 may comprise any generally resilient elastomeric material such as rubber, or like material.

In one embodiment, the flap valves 122 and 123 have a generally square or rectangular shape that corresponds to a generally square or rectangular cross sectional of the waste-receiving chamber 120. However, the waste-receiving chamber 120 and the flap valves 122 and 123 may have corresponding circular, triangular, oval, and other like shapes. As particularly illustrated in FIG. 1, the waste-receiving chamber 120 has a generally square or rectangular free end that tapers toward and forms a generally circular end that is operatively coupled to the vacuum chamber 112. In one embodiment, the waste-receiving chamber 120 is threadedly coupled to vacuum chamber 112 for disassembling and cleaning or repair. The square free end permits more clearance in the interior of the waste-receiving chamber 120 to allow or permit maximum pivoting of the flap valves 122 and 123.

Referring back to FIG. 1, a handle assembly 140 is operatively disposed on an opposed end of the housing assembly 110 to permit a user to easily carry and operate the system 100. In one example embodiment, the handle assembly 140 includes an actuator 150 operatively coupled thereto that is in operative communication with the vacuum assembly 200. As particularly illustrated in FIG. 1, the handle assembly 140 includes an elongate hollow shaft 142 having a generally undulating outer surface for conforming to a user's hand. A grip portion 144 may extend generally transverse from an end of the elongate hollow shaft 142. The grip portion 144 may also have a generally undulating outer surface to conform to a hand of the user. The elongate hollow shaft 142 and grip portion 144 are preferably manufactured from a plastic material. However, other materials such as metal, wood and like materials may also be used.

To activate the vacuum assembly 200, a user presses or switches the actuator 150 that is in either operative or electrical communication with the vacuum assembly 200. Once activated, the vacuum assembly 200 generates a suction lifting the pet waste and/or refuse into the waste-receiving chamber 120 where it is stored until there is a convenient time for disposal.

In one embodiment, the actuator 150 is in electrical communication with the vacuum assembly 200 comprising an electric motor adapted to generate suction to lift the pet waste and/or refuse into the waste-receiving chamber 120. A power supply (not shown) may be disposed within the vacuum chamber 112 and operatively coupled to the vacuum assembly 200 and the actuator 150. When the actuator 150 is activated, the vacuum assembly 200 generates a vacuum which lifts the flap valves 122 and 123 upwardly. The pet waste and/or refuse are then exposed to the vacuum lifting it into the waste-receiving chamber 120.

In a preferred example embodiment, as illustrated in FIG. 2, the vacuum assembly 200 comprises a plunger 210 slidably disposed in the interior of the vacuum chamber 112. The sliding of the plunger 210 in the interior creates a vacuum that draws air into the pocket 400 lifting the pet waste and/or refuse into the waste-receiving chamber 120.

Referring to FIGS. 2–8, the plunger 210 includes a body portion 212 and a generally axially aligned shaft portion 214 connected by an annular shoulder portion 216. The plunger 210 is slidable between a cocked position, as illustrated in FIG. 2 and an uncocked position as illustrated in FIG. 4. As the plunger 210 moves from the cocked position toward the uncocked position it creates a suction that lifts the pet waste and/or refuse into the waste-receiving chamber 120. The plunger 210 has side walls that confront an inner surface of vacuum chamber 112 to create a seal for generating the vacuum. In one example embodiment, a gasket (not shown) may be disposed about body portion 212 for sealing and to facilitate the creation of a strong vacuum. The gasket may be disposed about an entire surface area of the side walls or only a portion thereof.

The plunger 210 may be moved from the cocked position toward the uncocked position in a number of ways. In one example embodiment, the plunger 210 is operatively coupled to the handle assembly 140 such that a user may pull on handle assembly 140 to draw the plunger 210 from the cocked position toward the uncocked position. As the plunger 210 is pulled toward the uncocked position, the suction lifts the pet waste and/or refuse. To lift additional pet waste and/or refuse a user may push the handle assembly 140 down thereby returning the plunger 210 to the cocked position. Pulling on the handle assembly 140 again draws the already captured pet waste upward along with the pet waste in the pocket 400. Once the plunger 210 is in the uncocked position the vacuum is terminated and the flap valves 122 and 123 return to the closed position retaining the pet waste and/or refuse in the waste-receiving chamber 120.

Referring to FIGS. 2–11, a divider 160 may be conventionally disposed between the vacuum chamber 112 and the waste-receiving chamber 120 to prevent the pet waste and/or refuse from entering the vacuum chamber 112. The divider 160 may comprise a plate oriented generally perpendicular to a longitudinal axis of the vacuum chamber 112. As particularly illustrated in FIGS. 10 and 11, The divider 160 also includes a plurality of spaced apertures 162 extending therethrough for permitting air to flow into the vacuum chamber 112 from the waste-receiving chamber 120. Other types of dividers such as semi-permeable cloth or fabric may also be utilized. The apertures 162 may have a generally curved or angled cross section (not show) to facilitate the creation of a vortex within the waste-receiving chamber 120. The vortex aids in lifting the pet waste and/or refuse into the waste-receiving chamber 120.

In another example embodiment, as particularly illustrated in FIGS. 2–8, a biasing member 220 is conventionally disposed between the divider 160 and the body portion 212 of the plunger 210 to move the plunger 210 from the cocked position toward the uncocked position. The biasing member 220 may comprise a coiled spring or other similar structure. In this particular embodiment, the handle assembly 140 and/or actuator 150 may temporarily hold the plunger 210 in the cocked position. In the cocked position, the biasing member 220 is in a compressed state. Once the plunger 210 is released from the handle assembly 140 and/or actuator 150, the biasing member 220 expands urging the plunger 210 from the cocked position toward the uncocked position.

The shaft portion 214 travels within and is received by a plunger-receiving chamber 222. The plunger-receiving chamber 222 includes a shoulder portion 224 and a neck portion 226. As the plunger 210 moves from the cocked position toward the uncocked position pressurized air may form in the vacuum chamber 112. The shoulder portion 224 includes at least one vent 228 to permit the pressurized air to escape. The shoulder portion 224 may also include a valve for controlling the rate or speed the plunger 210 moves from the cocked position toward the uncocked position. The plunger-receiving chamber 222 is threadedly coupled to the vacuum chamber 120 for easy assembly and disassembly of the housing assembly 110.

In one embodiment, the actuator 150 includes a pin 240 that maintains the plunger 210 in the cocked position. The pin 240 is preferably pivotally disposed at an end of the actuator 150 and preferably extends through an elongate slot 252 of the neck portion 226 of the plunger-receiving chamber 222. To generate the suction, the user presses the actuator 150 which pulls the pin 240 away from engagement with the neck portion 214 of the plunger 210 thereby permitting the biasing member 220 to expand and move the plunger 210 toward the uncocked position and away from the divider 160.

In an example embodiment of the invention, the handle assembly 140 is utilized to move the plunger 210 from the uncocked position toward the cocked position and upon the biasing member 220. As illustrated in FIG. 4, after the actuator 150 has been activated and the pet waste and/or refuse is contained in the waste-receiving chamber 120, the shaft portion 214 is disposed within the plunger-receiving chamber 222. The user then depresses a spring-loaded button 258 being conventionally attached to the elongate hollow shaft 142 of the handle assembly 140 which engages a handle-locking member 260 (see FIG. 9) being pivotally coupled to the neck portion 226 of the plunger-receiving chamber 222 and being biasedly engaged by a first leaf spring 280 in a slot 146 of the elongate hollow shaft 142 of the handle assembly 140. Upon depressing the spring-loaded button, the user moves the handle-locking member 260 out of the slot 146 of the elongate hollow shaft 142. The user then simply pulls the handle assembly 140 away from the vacuum chamber 112.

Figure 5:
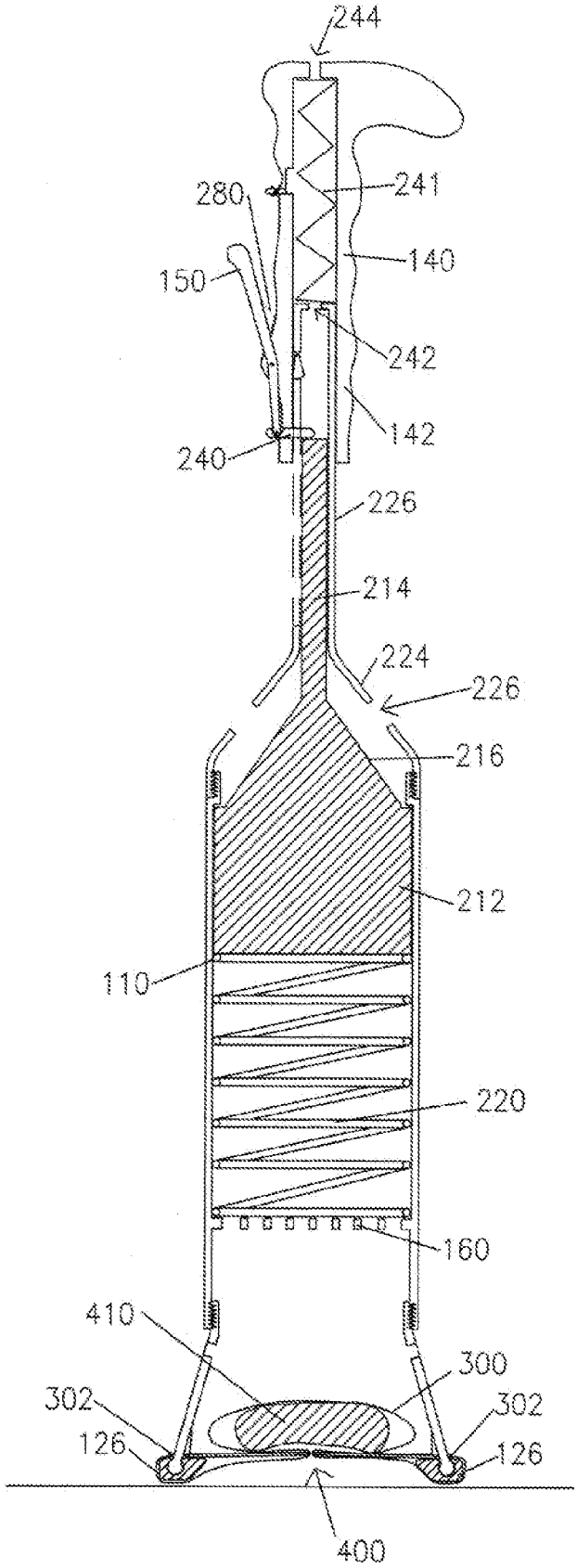
FIG. 5 is a cross section view of the system in the post-vacuum position and a handle in an extended position prior to resetting the plunger.
Figure 6:
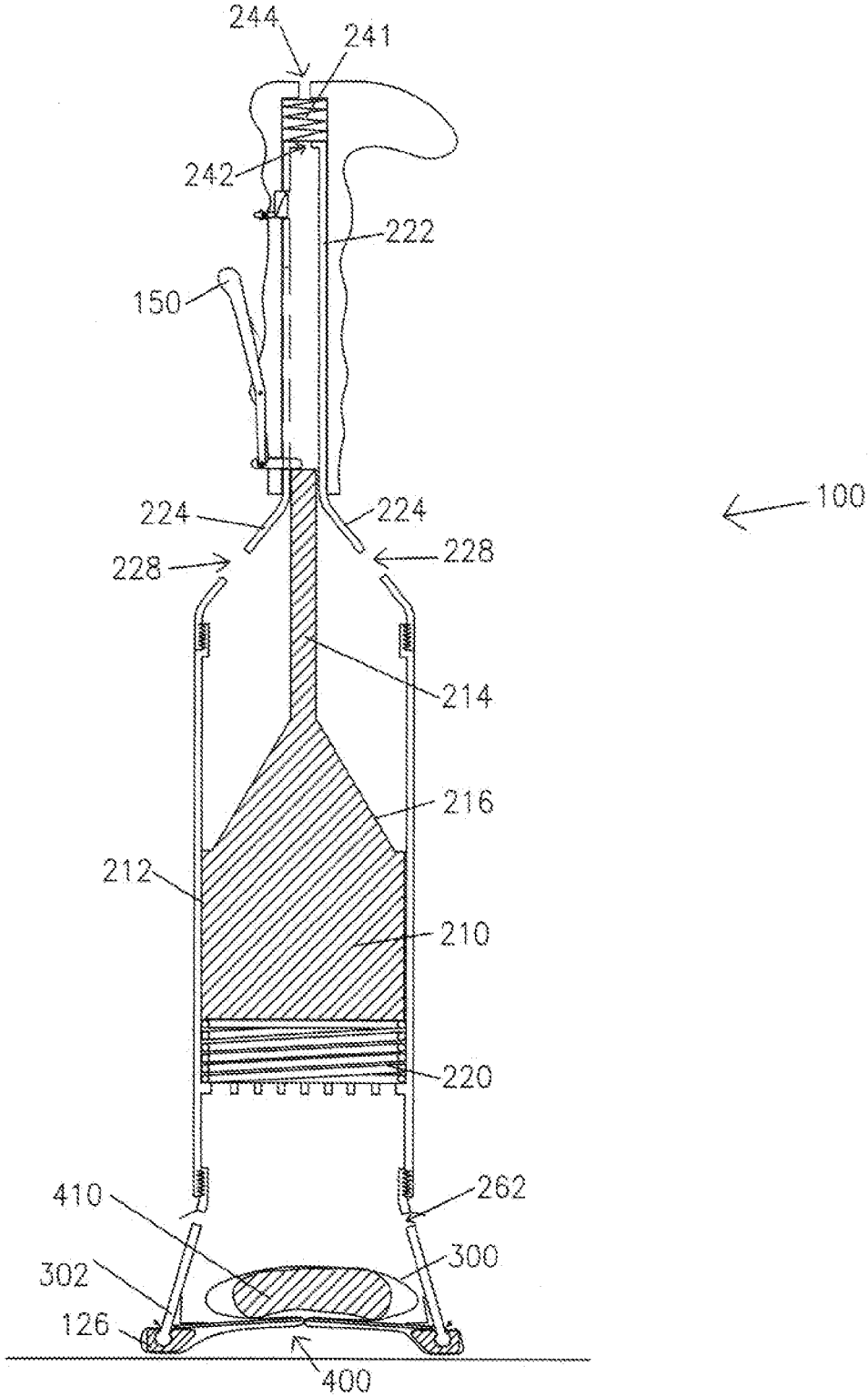
FIG. 6 is a cross section view of the system in a reset position with the plunger in the pre-vacuum position.
Figure 7:
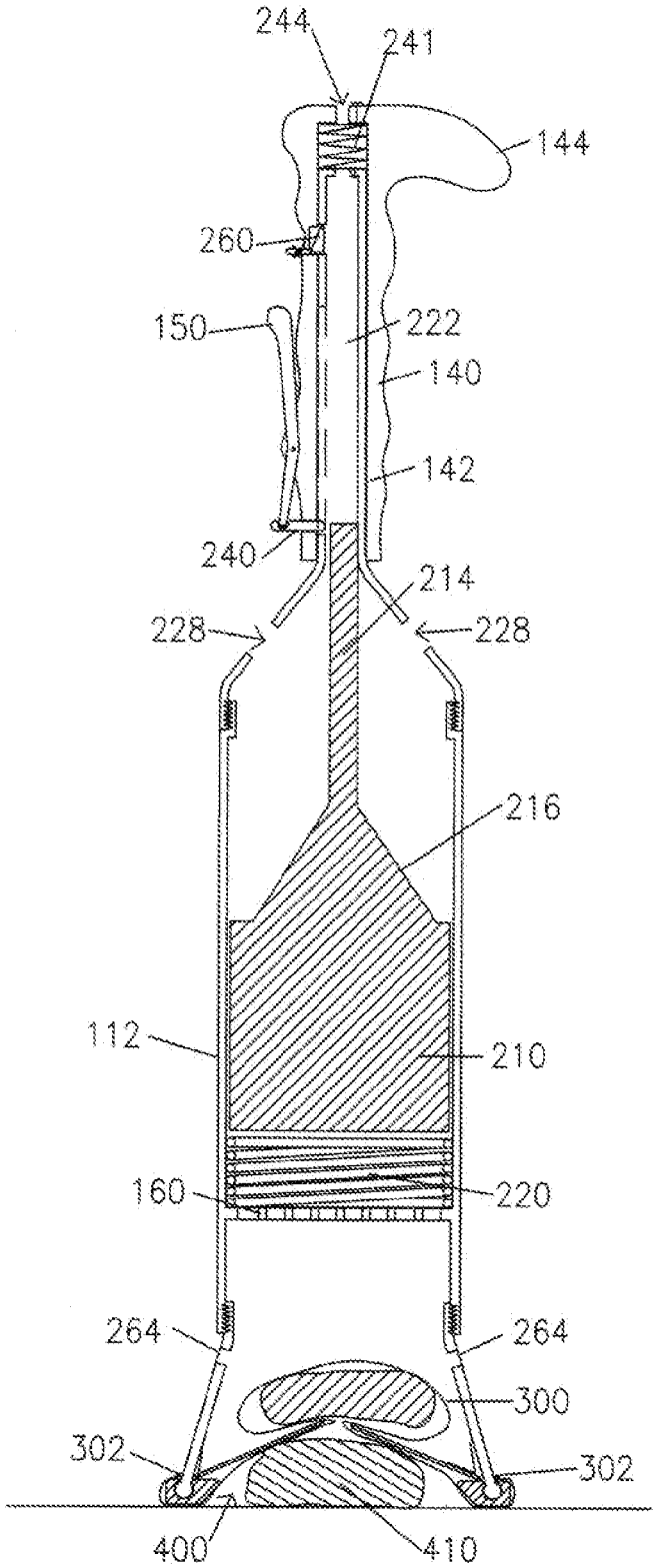
FIG. 7 is a cross section view of the system illustrating a second pet waste collection step.

As illustrated in FIG. 5, once the handle assembly 140 is pulled upwardly, the pin 240 engages the shaft portion 214 of the plunger 212. A second leaf spring 239 may be operatively disposed between the actuator 150 and the elongate hollow shaft 142 to continuously urge the pin 240 into the elongate slot 252 extending along at least a partial length of the neck portion 226 of the plunger-receiving chamber 222 and also into one of the slots 148 of the elongate hollow shaft 142. At the upper limits of movement of the handle assembly 140, the pin 240 engages an end of the shaft portion 214 of the plunger 212. The user may then push downwardly on the grip portion 144 of the handle assembly 140 to force the plunger 212 into the cocked position as illustrated in FIG. 6. Once in the cocked position, the handle-locking member 260 is biased outwardly to engage one of the slots 146 of the elongate hollow shaft 142 of the handle assembly 140 thereby keeping it in a fixed position with respect to the vacuum chamber 112. The user may then depress the actuator 150 again, as illustrated in FIG. 7, to pick up additional pet waste and/or refuse.

As particularly illustrated in FIG. 5, a retainer 241 is disposed in the plunger-receiving chamber 222 and is operatively coupled to the shaft portion 214 and to an inner surface of the handle assembly 140. The retainer 241 may comprise a spring or similar resiliently compressible structure.

FIG. 5 also discloses that a first air hole 242 may extend through the neck portion 224 of plunger-receiving chamber 222 for permitting air trapped in the plunger-receiving chamber 222 to escape as the plunger 212 moves from the cocked position toward the uncocked position. It also permits air to escape when utilizing the handle assembly 140 to move the plunger 212 from the uncocked position toward the cocked position. The first air hole 242 may be in registration with a second air hole 244 extending through the grip portion 144 of handle assembly 140 to permit the air to flow freely therethrough.

In one example embodiment, any air generated by moving the plunger 212 from the uncocked position toward the cocked position may escape through at least one hole 262 being formed or coupled to the waste-receiving chamber 120. As illustrated in FIG. 11, at least one flexible air valve member 264 may operatively and/or pivotally coupled to the waste-receiving chamber 120 to selectively cover the at least one hole 262. The flexible air valve member 264 is preferably unidirectional such that when the vacuum is generated it is pulled inward toward the waste-receiving chamber 120 blocking the at least one hole 262.

In one example embodiment, a waste receptacle assembly including a collector 300 comprising a semi-permeable sheet, bag, sac, or like structure is removably disposable about the opening 124 to collect the pet waste and/or refuse being vacuumed into the waste-receiving chamber 120. The collector 300 may include an elastomeric peripheral edge for removably securing the collector 300 around an outer surface of the waste-receiving chamber 200. In another example embodiment, a separate elastomeric band 302 or other securing means may be disposed to the outer surface of the waste-receiving chamber 120 for at least temporarily securing the collector 300 thereto.

As illustrated in FIGS. 2–7, & 11, the collector 300 extends over the gasket 126 and at least a portion extends into the interior of the waste-receiving chamber 120. In one embodiment, a user may attach the collector 300 about the opening 124 and actuate a dry-run of the vacuum assembly 200. The suction will pull at least a portion of the collector 300 into the waste-receiving chamber 120. As illustrated in FIG. 2, once the collector 300 is at least partially disposed within the waste-receiving chamber 200 it can be used to collect the pet waste and/or refuse. In this particular embodiment, the collector 300 is preferably a thin generally porous material that does not interfere with the operation of the flap valves 122 and 123.

Figure 8:
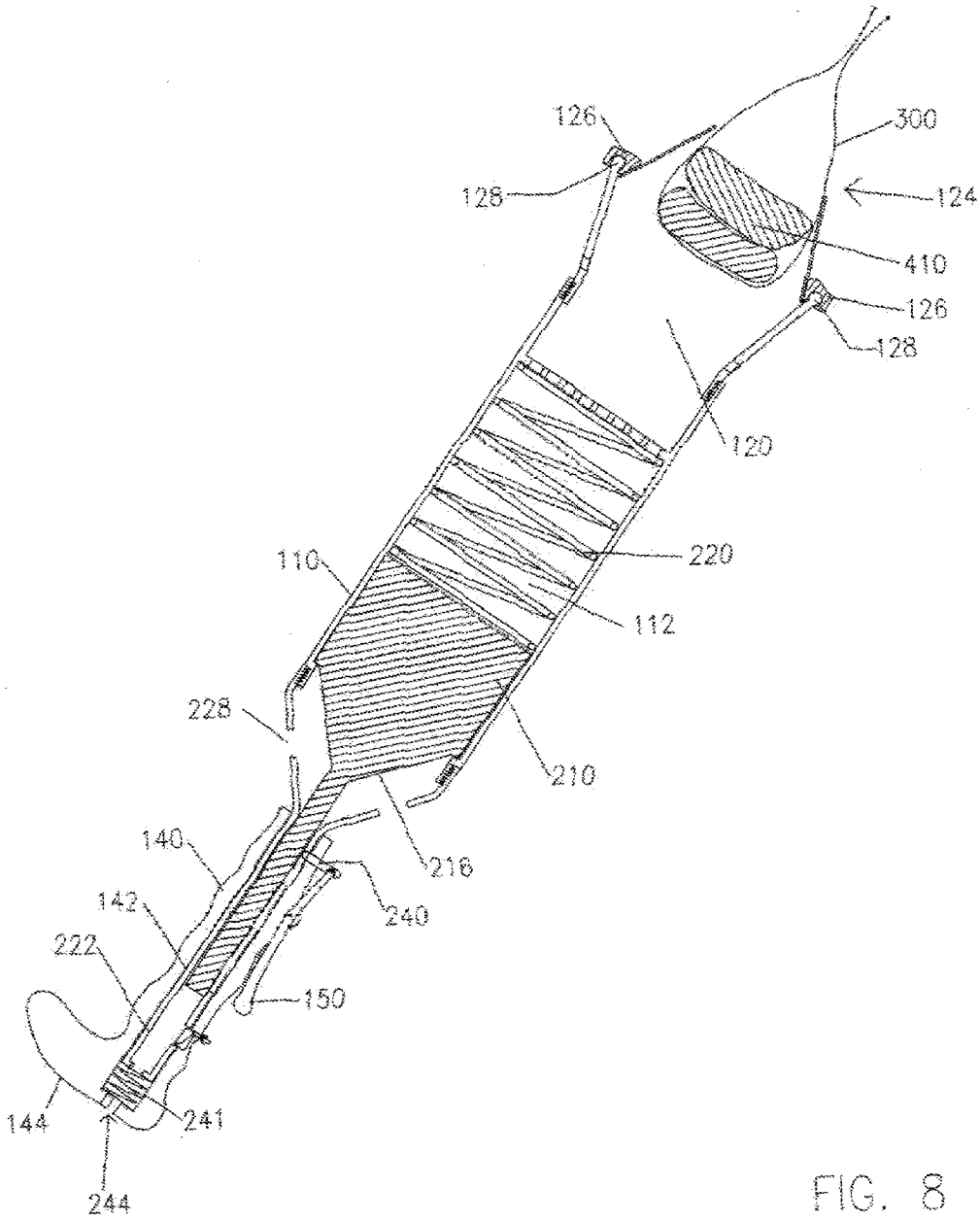
FIG. 8 is a cross section view of the system illustrating removal of the collected pet waste.
Figure 9:
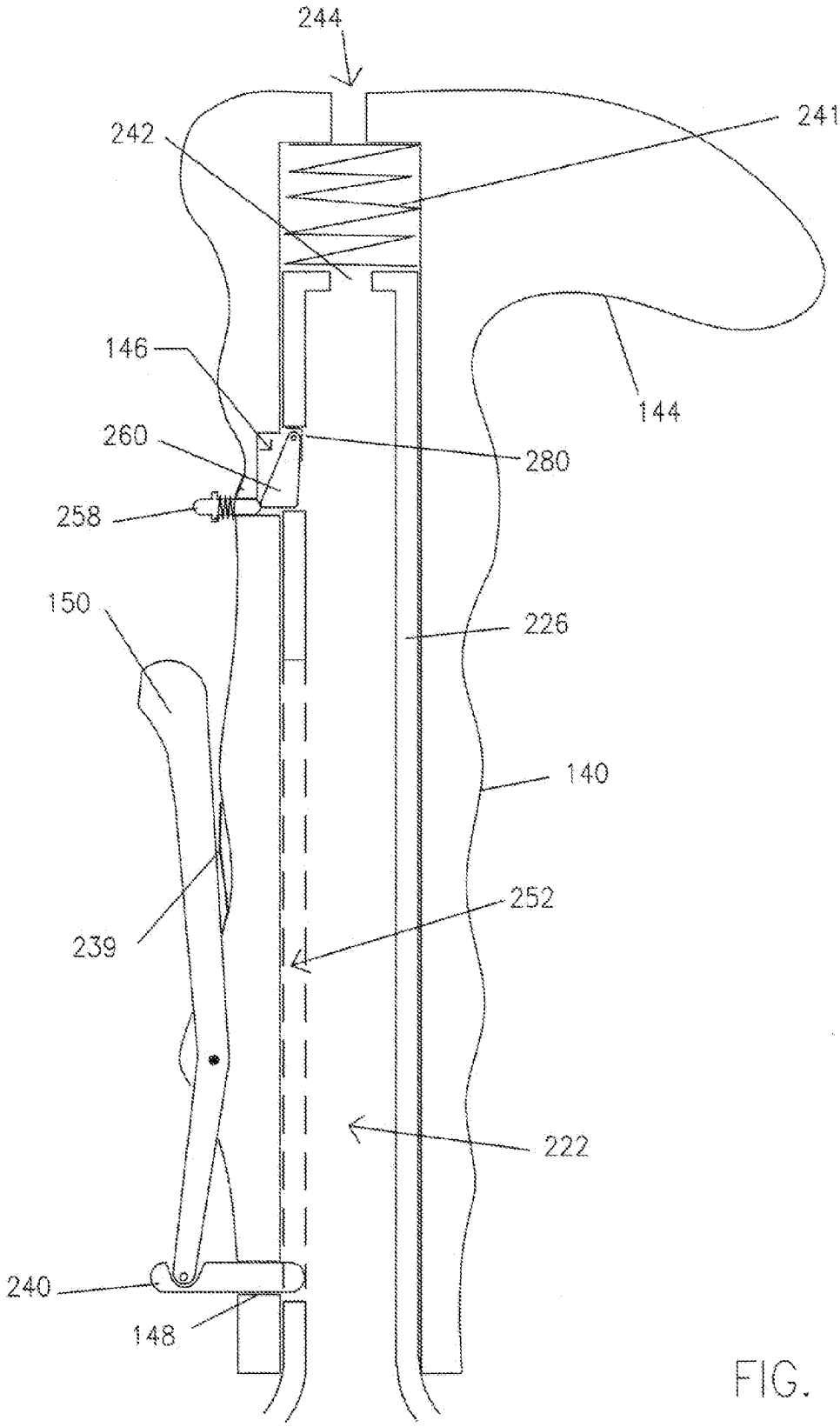
FIG. 9 is an enlarged view of a handle assembly of the system.
Figure 10:
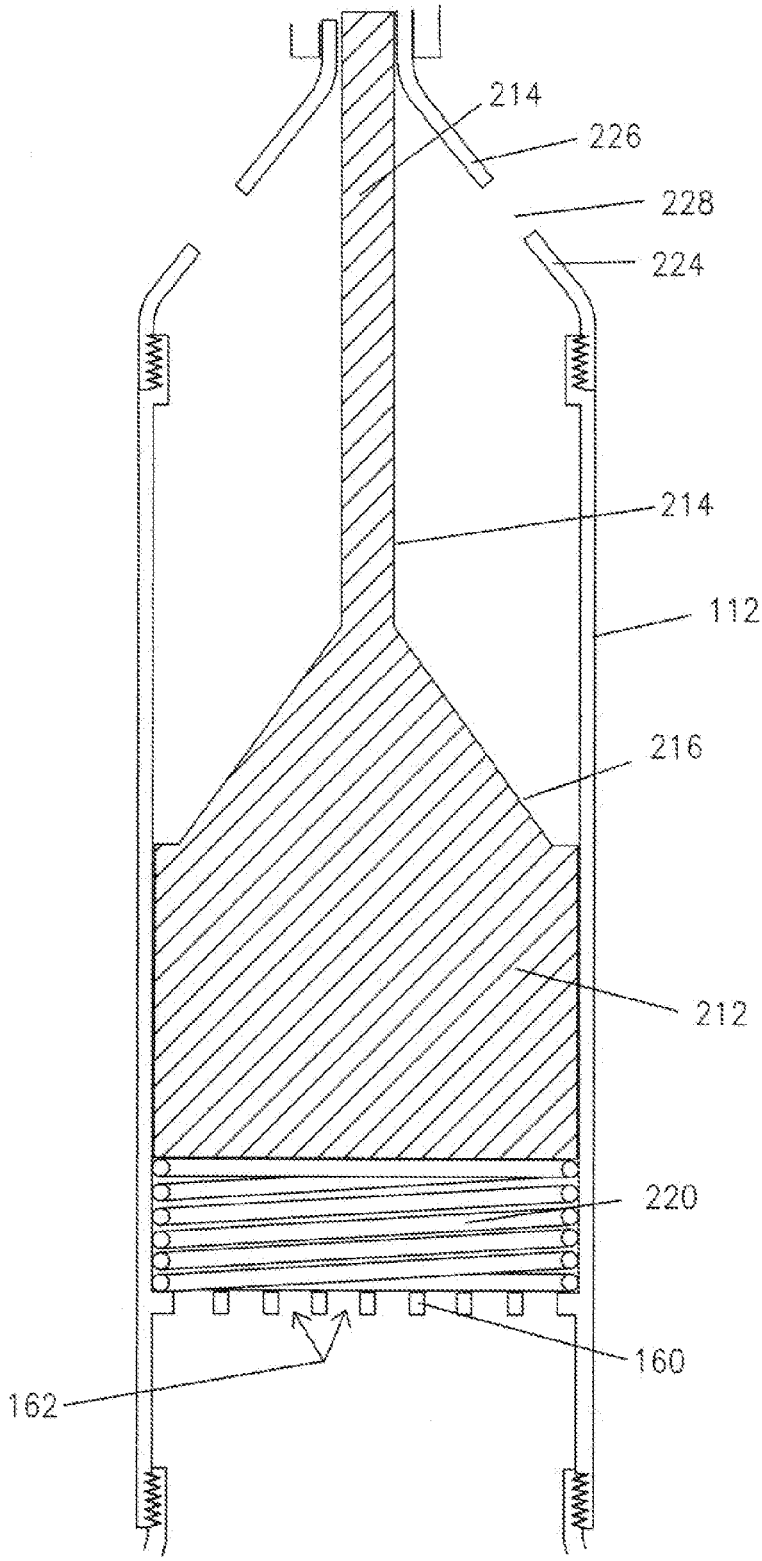
FIG. 10 is an enlarged view of a vacuum assembly of the system.

As illustrated in FIG. 8, after the pet waste and/or refuse has been collected the flap valves 122 and 123 may be either pivoted inward, or as shown outward, to permit removal of the collector 300. Once the collector 300 is detached from the waste-receiving chamber 120 it may be twisted and/or tied for disposal in a proper waste receptacle.

In another example embodiment, the collector 300 may be completely contained within the waste-receiving chamber 300. In this embodiment, after pet waste and/or refuse is collected a user may rotate the waste-receiving chamber 120 to twist, tie and/or close a mouth or opening of the collector 300. The collector 300 may comprise a generally tacky material such that twisting and/or tying the collector 300 maintains a general seal enclosing the pet waste and/or refuse. Once the pet waste and/or refuse is enclosed, a user may simply pull a lever operatively coupled to the flap valves 122 and 123 to discharge the collecting member 300 and waste. Pulling the lever permits the flap valves 122 and 123 to swing open as illustrated in FIG. 8. Once the collector 300 is discharged, a user may insert another collector 300 for use. In another example embodiment, a user can twist or rotate the waste-receiving chamber 120 to position another collecting member 300 for capturing the pet waste and/or refuse.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A vacuum-actuated waste collection system comprising:

a housing assembly including a vacuum chamber being disposed therein and also having a waste-receiving chamber being in fluid communication with said vacuum chamber and further having a plunger-receiving chamber also be in fluid communication with said vacuum chamber, said housing assembly further including a divider separating said vacuum chamber from said waste-receiving chamber and having a plurality of apertures being disposed therethrough to allow air to pass through said divider, said waste-receiving chamber including an opening through which the waste is received into said waste-receiving chamber, and also including at least one flap valve for opening and closing said opening into said waste-receiving chamber, and further including a peripheral lip being disposed at an end of said waste-receiving chamber adjacent to said opening into said waste-receiving chamber, and also including a gasket being disposed about said peripheral lip, said at least one flap valve and said gasket cooperatively forming a pocket to facilitate vacuuming the waste into said waste-receiving chamber;

a vacuum assembly to form a suction to move waste into said housing assembly from outside said housing assembly;

a handle assembly being movably disposed about a portion of said housing assembly; and a waste receptacle assembly for receiving the waste inside said housing assembly.

2. The vacuum-actuate waste collection system as described in claim 1, wherein said waste-receiving chamber further includes at least one hole being disposed through a wall thereof, and also includes at least one flexible air valve member being pivotally disposed in said at least one hole for allowing air to selectively pass therethrough.

3. The vacuum-actuated waste collection system as described in claim 1, wherein said plunger-receiving chamber includes a neck portion having an air hole being disposed through an end wall thereof, and also includes a shoulder portion having at least one vent for releasing air from said vacuum chamber, and further includes an elongate slot being disposed through a side wall of said neck portion.

4. The vacuum-actuated waste collection system as described in claim 3, wherein said vacuum assembly includes a plunger being movably disposed in said vacuum chamber, and also includes a biasing member for moving said plunger away from said divider to form a suction to move the waste from said pocket to said waste-receiving chamber.

5. The vacuum-actuated waste collection system as described in claim 4, wherein said biasing member is a spring being disposed upon said divider in said vacuum chamber and being engaged to said plunger.

6. The vacuum-actuated waste collection system as described in claim 4, wherein said plunger includes a body portion and a shaft portion.

7. The vacuum-actuated waste collection system as described in claim 6, wherein said handle assembly includes a grip portion and an elongate hollow shaft being slidably disposed about said neck portion of said plunger-receiving chamber for moving said plunger toward said divider and urging said plunger against said biasing member in a cocked position, said elongate hollow shaft having a plurality of slots being disposed through a side wall thereof.

8. The vacuum-actuated waste collection system as described in claim 7, wherein said vacuum assembly further includes an actuator being pivotally connected to said side wall of said elongate hollow shaft for holding said plunger in the cocked position and also for releasing said plunger from the cocked position to allow said biasing member to move said plunger away from said divider thus forming a suction, and also includes a handle-locking member being pivotally mounted to said neck portion of said plunger-receiving chamber and being biasedly disposed to and removable from one of said slots of said elongate hollow shaft to lock said elongate hollow shaft to said plunger-receiving chamber.

9. The vacuum-actuated waste collection system as described in claim 8, wherein said vacuum assembly further includes a resilient retainer being attached to said end wall of said neck portion of said plunger-receiving chamber and being attached within said elongate hollow shaft for keeping said elongate hollow shaft about said neck portion of said plunger-receiving chamber upon said elongate hollow shaft being moved outwardly away from said vacuum chamber to allow a user to re-cock said plunger.

10. The vacuum-actuated waste collection system as described in claim 9, wherein said vacuum assembly also includes a first leaf spring being attached to said neck portion of said plunger-receiving chamber for biasedly disposing said handle-locking member in one of said slots of said elongate hollow shaft to lock said elongate hollow shaft to said plunger-receiving chamber.

11. The vacuum-actuated waste collection system as described in claim 10, wherein said vacuum assembly further includes a second leaf spring being attached to said elongate hollow shaft for biasedly disposing said actuator in one of said slots of said elongate hollow shaft and in said elongate slot of said neck portion of said plunger-receiving chamber and into engagement with said neck portion of said plunger to releasably lock said plunger in the cocked position.

12. The vacuum-actuated waste collection system as described in claim 11, wherein said vacuum assembly also includes a pin being pivotally attached to said actuator and being biasedly disposed in and removable from one of said slots of said elongate hollow shaft and said elongate slot of said neck portion of said plunger-receiving chamber and being removably engaged to said neck portion of said plunger to removably hold said plunger in the cocked position.

13. A vacuum-actuated waste collection system comprising:

a housing assembly;

a vacuum assembly to form a suction to move waste into said housing assembly from outside said housing assembly;

a handle assembly being movably disposed about a portion of said housing assembly; and a waste receptacle assembly for receiving the waste inside said housing assembly, said waste receptacle assembly including a collector being removably disposed in said waste-receiving chamber, and also including an elastomeric band being removably disposed about a portion of said waste-receiving chamber and being engageable to said collector to removably hold said collector to said waste-receiving chamber.

* * * * *